United States Patent [19]

Hogarth

[11] Patent Number: 5,027,480

[45] Date of Patent: Jul. 2, 1991

[54] GARMENT CLIP

[75] Inventor: Donald J. Hogarth, Miranda, Australia

[73] Assignee: Rainsford Pty Limited, Kingsgrove, Australia

[21] Appl. No.: 525,499

[22] Filed: May 18, 1990

[51] Int. Cl.[5] ..... A41F 1/00

[52] U.S. Cl. ..... 24/543; 24/545; 24/487

[58] Field of Search ..... 24/543, 544, 545, 453, 24/563, 461, 297

[56] References Cited

U.S. PATENT DOCUMENTS

| | | | |
|---|---|---|---|
| De. 234,204 | 1/1975 | Miller et al. | 24/543 |
| 3,604,071 | 9/1971 | Reimels | 24/543 |
| 3,698,043 | 10/1972 | Batts | 24/543 |
| 3,698,607 | 10/1972 | Batts | 24/543 |
| 3,745,616 | 7/1973 | Batts | 24/543 |
| 4,194,274 | 3/1980 | Garrison | 24/487 |
| 4,536,924 | 8/1985 | Willoughby | 24/545 |
| 4,826,056 | 5/1989 | Duester et al. | 24/487 |

*Primary Examiner*—Victor N. Sakran

*Attorney, Agent, or Firm*—Hopgood, Calimafde, Kalil, Blaustein & Judlowe

[57] ABSTRACT

A garment clip is disclosed comprised of first and second jaws pivotably joined together about a hinge line. A securement device is provided to releasably lock the relative angular position of the two jaws, the jaws being provided with a first garment gripping means on the first jaw and a second garment gripping means on the second jaw so that during use of a garment portion to be gripped is sandwiched between the two jaws and the garment gripping means, whereby the first and second garment gripping means distort the garment therebetween into a three dimensionally curved surface.

6 Claims, 6 Drawing Sheets

GARMENT CLIP

The present invention relates to hanger clips and more specifically to hanger clips formed in one piece by a single production operation.

A number of advantages are achievable over the prior art by being able to produce hanger clips in a single production operation. Some of the advantages available are, a reduction in the production cost of the clips, an ability to form the clips as an integral member of clothing support devices or the like, an ability to mass produce the clips individually or attached to any mass produceable item which incorporates the use of such a clip.

Furthermore, the tooth and ratchet arrangement of the present invention offer added advantages over the prior art by trapping around its periphery the ratchet thus preventing the deflection of the ratchet under load and subsequent release of the tooth thereby.

Also, when a spreading pressure is applied between the jaws, such pressure causes the ratchet tooth to further tighten and engage the opposing clip tooth thus retaining the clips holding ability.

Due to the configuration and interworking relationship between members of the prior art clips, it has proven difficult to produce hanger clips by a single production operation to date.

Furthermore most hanger clips have two jaws which are closed against each other to sandwich part of a garment therebetween. The opposing faces of the two jaws only have a corrugated surface, usually of one or two transverse ribs extending away from the general plane of the jaw.

The affect of the transverse ribs is to fold the gripped garment slightly, thereby increasing the holding power of the clip. Although the transverse ribs increase the gripping power of the clip it is still relatively easy for the gripped garment to slip out of the clip. Furthermore with thick material the ribs do not produce much folding of the material and thus are not very effective.

Accordingly the present invention provides a clip comprising a front jaw and a rear jaw flexibly hinged about a first main geometric axis and defining an including therebetween:

ratchet means integral with said rear jaw, ratchet engaging means integral with said front jaw for releasably engaging said ratchet means, engagement of said ratchet with said ratchet engaging means allows said included angle to decrease but not increase.

In another broad form the invention also provides:

a garment clip having first and second jaws pivotably joined together about a hinge line, securement means to releasably fix the relative angular position of the two jaws, first garment gripping means on the first jaw, second garment gripping means on the second jaw, wherein in use:

the first and second garment gripping means are brought into proximity to grip a piece of the garment, the garment intermediate the two jaws following a three dimensionally curved surface.

Preferably the securement means is a self locking ratchet, wherein a force urging the jaws apart increases the effect of the securement means.

Preferably the first garment gripping means comprises an extrusion extending substantially perpendicularly from the general plane of the first jaw and having two protrusions on its upper surface and the second garment gripping means comprises an extrusion extending substantially perpendicularly from the general plane of the second jaw, the second means, when proximately to the first means, being intermediate the two protrusions.

Preferably, the hanger clip is formed as a single unit, the front and rear jaws being hinged along an edge which, when the jaws are in a gripping orientation, may be described as an upper edge. The ratchet is integrally formed in perpendicular relation to the rear jaw of the ratchet serations being formed in the upper surface thereof. The ratchet engaging and release means is integrally formed in the front jaw so that the ratchet may pass through an opening in the front jaw when the jaws are brought into gripping relation allowing the ratchet engaging means to engage said ratchet. The ratchet engaging and release means is further described by an arm protruding outwards from the front jaw which when depressed allows the front and rear jaws to be opened and release any item held between them. To further assist in the gripping of items between the front and rear jaws, gripping means are integrally formed on the inside faces of the jaws.

The present invention will now be described with reference to the accompanying drawings wherein.

The hanger clip 1 is preferably formed of moulded plastic although any material exhibiting resilient characteristics may be used.

Figure 1:
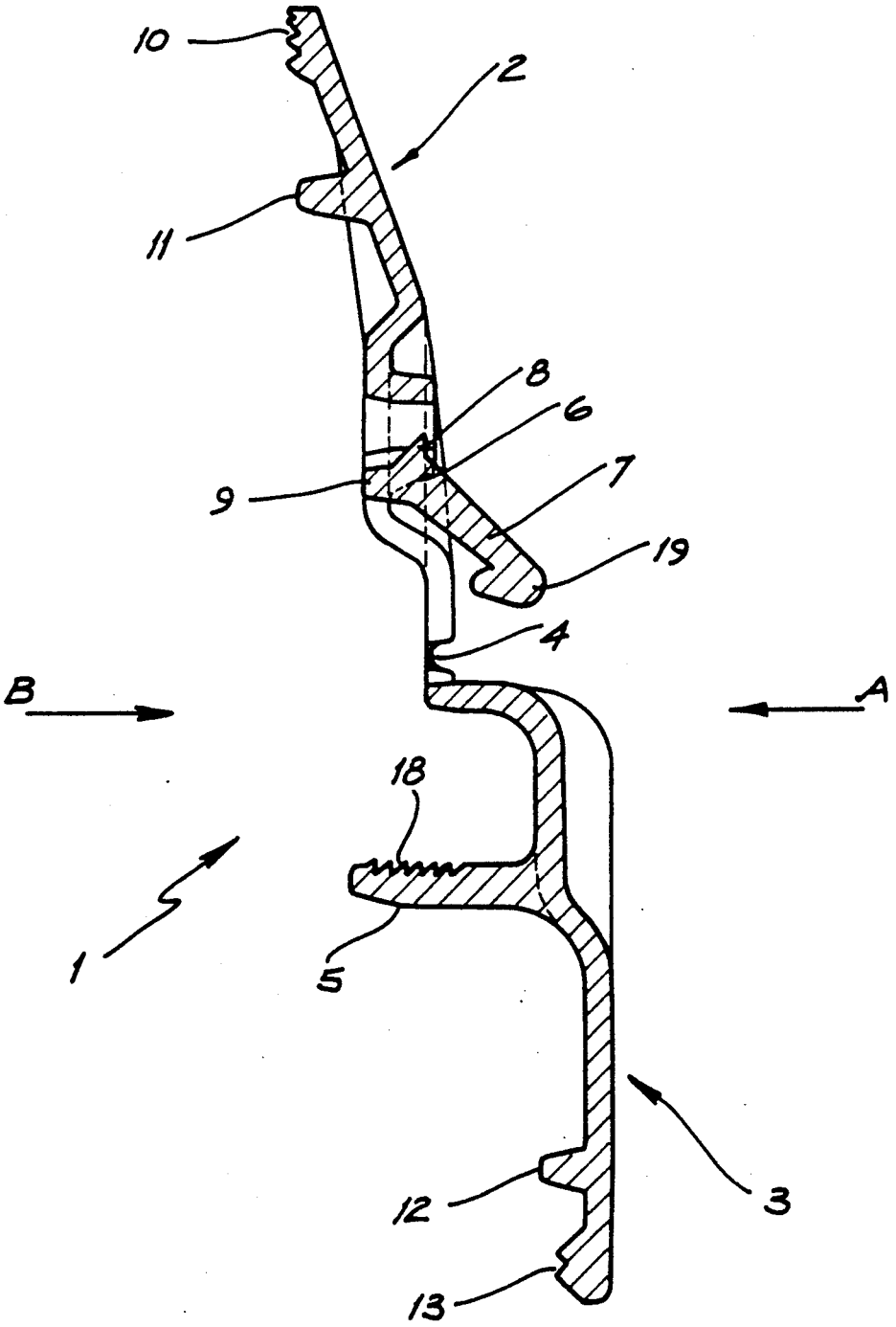
FIG. 1 shows a sectional elevation of the clip as formed.
Figure 2:
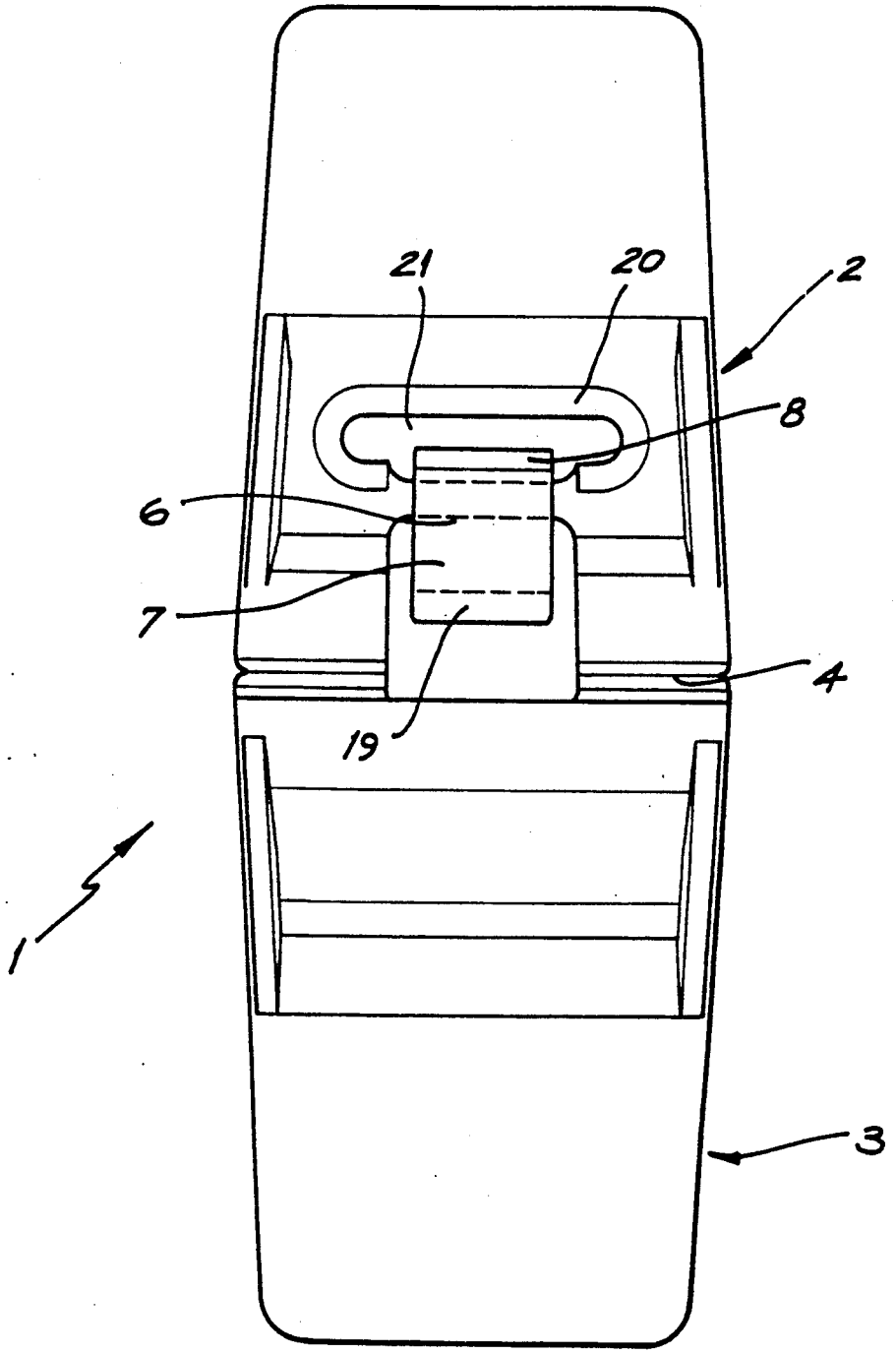
FIG. 2 shows the front and rear jaws of the clip in the as formed position when viewed from direction A.

Reference to FIG. 1 clearly shows the clip 1 in cross sectional elevation as it would appear after forming. The clip 1 can be seen to have a front jaw 2 and rear jaw 3 joined by a resilient hinge 4.

The rear jaw 3 is shown to having integrally formed thereon a ratchet 5 standing substantially perpendicularly to the rear jaw 3.

The front jaw 2 is shown to have integrally attached thereto ratchet engaging means 6 described by a resilient arm 7 and tooth 8. The ratchet engaging means 6 is integrally attached to cross member 9 which also acts as a resilient hinge in respect of the ratchet engaging means 6.

Figure 3:
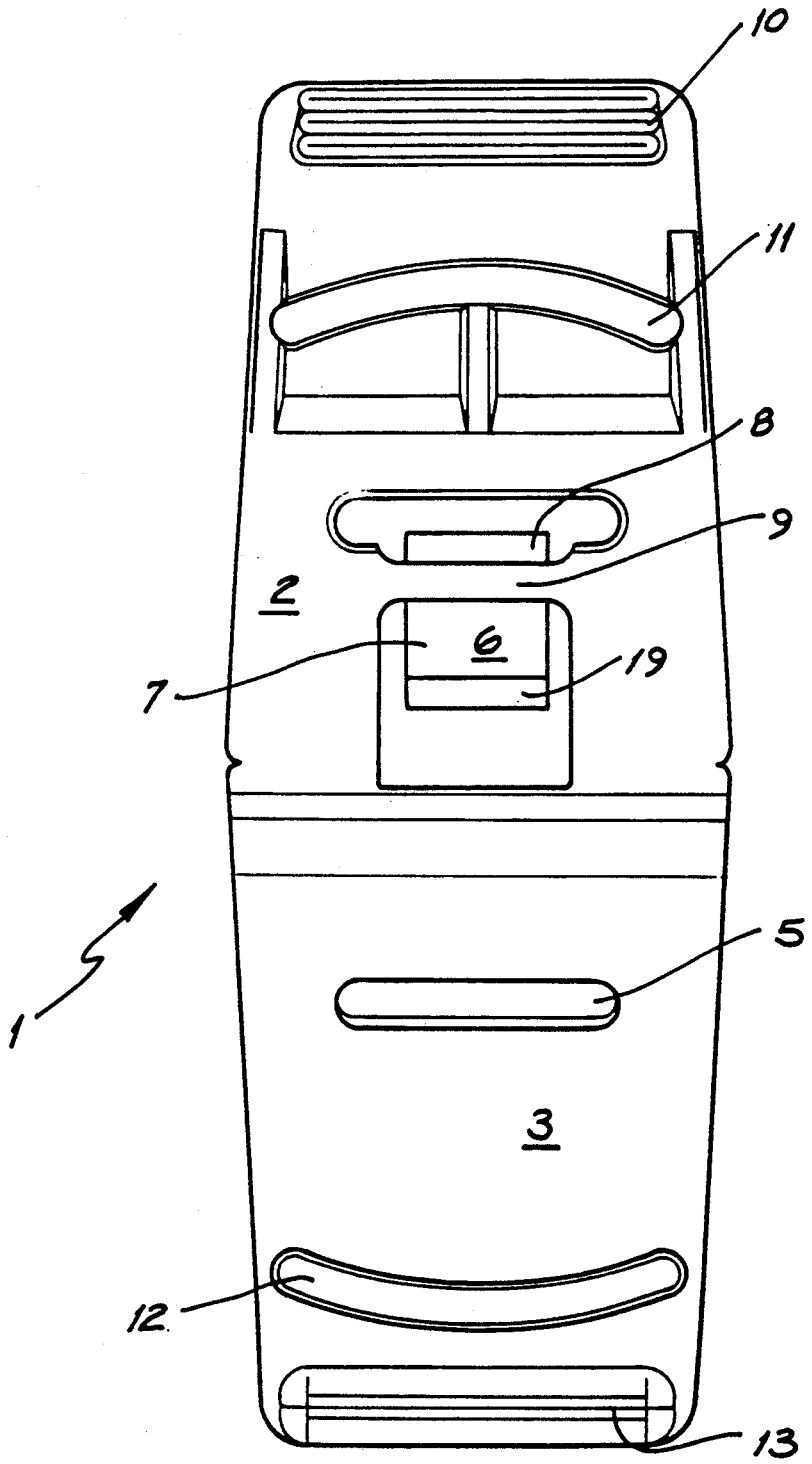
FIG. 3 shows the front and rear jaws of the clip in the as formed position when viewed from direction B.

With particular reference to FIGS. 1 and 3 garment engaging means 10, 11, 12 and 13 are shown formed on the inside surfaces of front and rear jaws 2 and 3.

Figure 4:
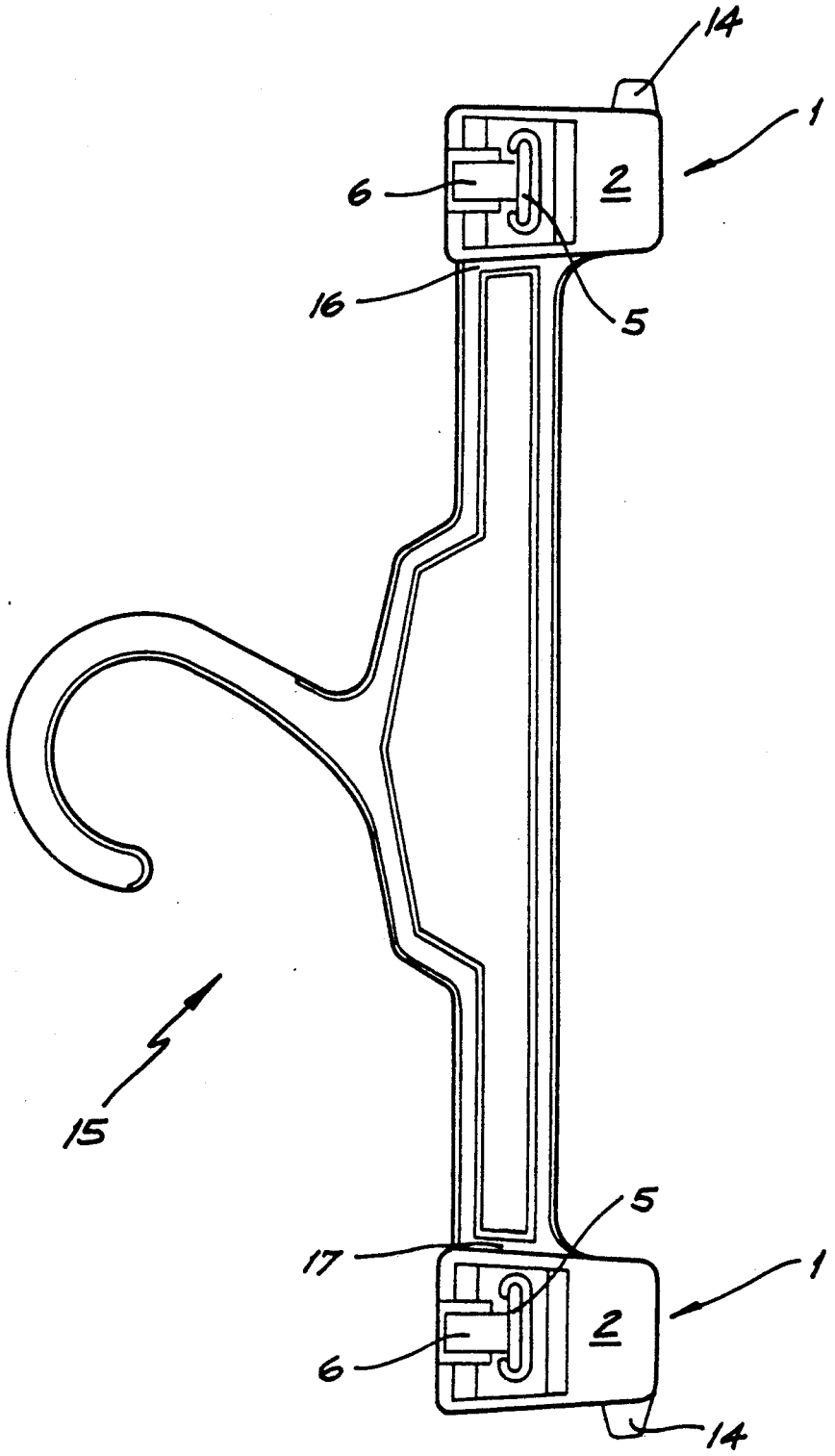
FIG. 4 shows the clip when in use with a garment hanger.

Reference to FIG. 4 shows the front jaw 2 of the clip 1 to also have integrally formed a flap 14 which assists the user in opening the clip 1 when the clip 1 is in use with a garment hanger 15.

Preferably the clip 1 is integrally formed as part of the garment hanger 15 at each end 15 and thereof as best described in FIG. 4.

In the configuration as shown in FIG. 4, garments may be supported by the hanger by engaging the garments to be supported with the clips 1.

Engagement of the garments would be carried out by depressing the arm 7 of the ratchet engaging means 6 causing thew tooth 8 to be disengaged from the teeth 18 of the ratchet 5. While maintaining the arm 7 in a depressed position, the front jaw 2 is moved forward until the tooth 8 of the ratchet engaging means 6 is clear of the ratchet 5.

Any garment previously engaged between the front and rear jaws 2 and 3 respectively are released or any garment may be placed therebetween.

Having placed a garment between the front jaw 2 and rear jaw 3, the clip 1 is caused to engage the garment by closing the jaws 2 and 3, causing the garment engaging means 10, 11, 12 and 13 to engage the garment and the tooth 8 of the ratchet engaging means 6 to engage the teeth 18 of the ratchet 5.

The ratchet 5, in the clip closed position, is prevented from deflecting and resultingly disengaging the tooth 8 of the ratchet engaging means 6, due to peripheral support supplied to the ratchet 5 by the surround 20 of the opening 21.

Increasing the pressure applied to the front jaw 2 and rear jaw 3 will cause the tooth of the ratchet engaging means 6 to move inwards toward the rear jaw 3 and engage successive teeth 18 of the ratchet 5 until an adequate engagement pressure has been achieved ensuring the secure engagement of a garment.

As applied to a garment hanger 15 the garment engaged by the clips 1 may then be hung on a rack to the like.

Opening pressure applied between the jaws 2 and 3, as encountered by overtightening of the clip 1, causes the jaws 2 and 3 to separate slightly in turn causing the tooth 8 of the ratchet engaging means 6 to further engage the teeth 18 of the ratchet 5 and tighten with respect thereto thus retaining the clips 1 holding ability. This is because separation of the two jaws 2 and 3 causes a rotation of ratchet engaging means 6 about cross member 9.

To release the garment from the hanger 15, the ratchet engaging means 6 is depressed by applying pressure to the outward end 19 of the resilient arm 7 of the ratchet engaging means 6 causing the cross member 9 to undergo torsional rotating and release the tooth 8 of the ratchet engaging means 6 from the teeth of the ratchet 5.

While depressing the outward end 19 of the resilient arm 7 of the ratchet engaging means 6, the front jaw 2 is then caused to hinge forward releasing the engaged garment.

Figure 5:
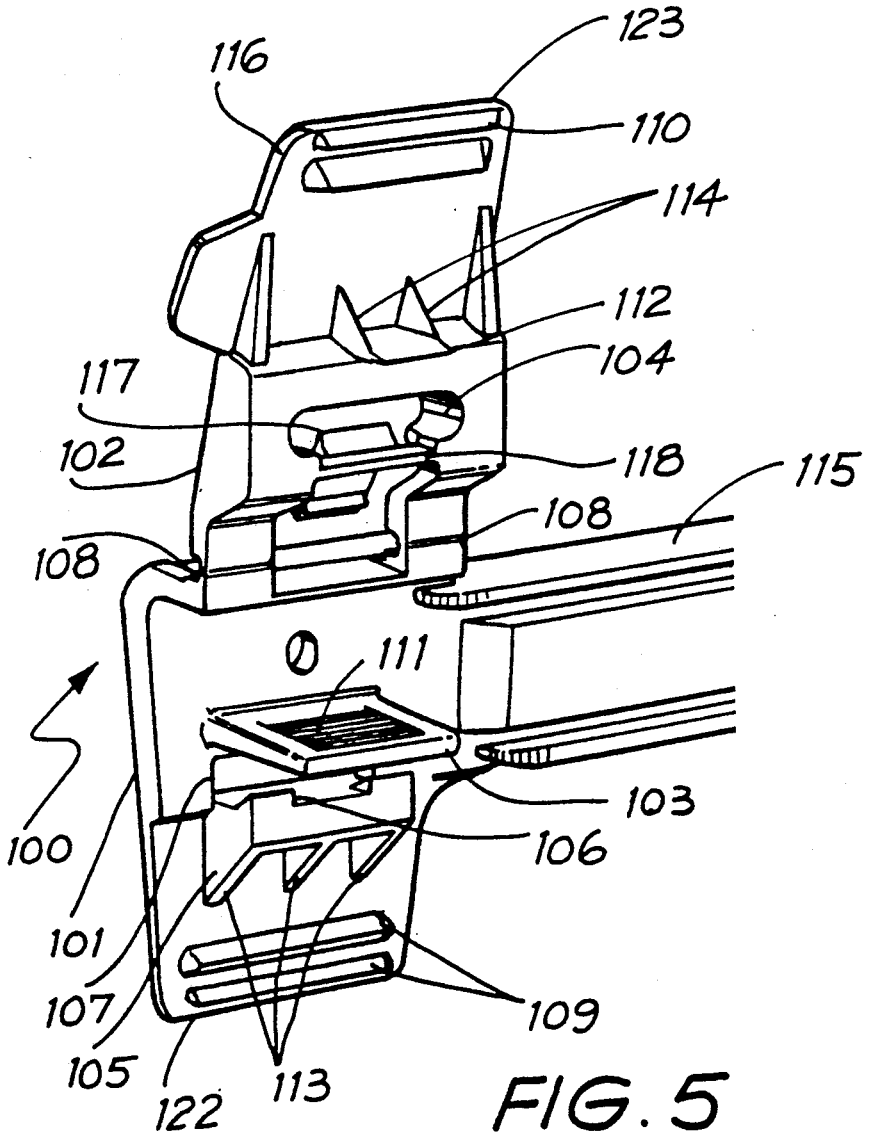
FIG. 5 shows a perspective of a clip according to another embodiment of the invention.
Figure 6:
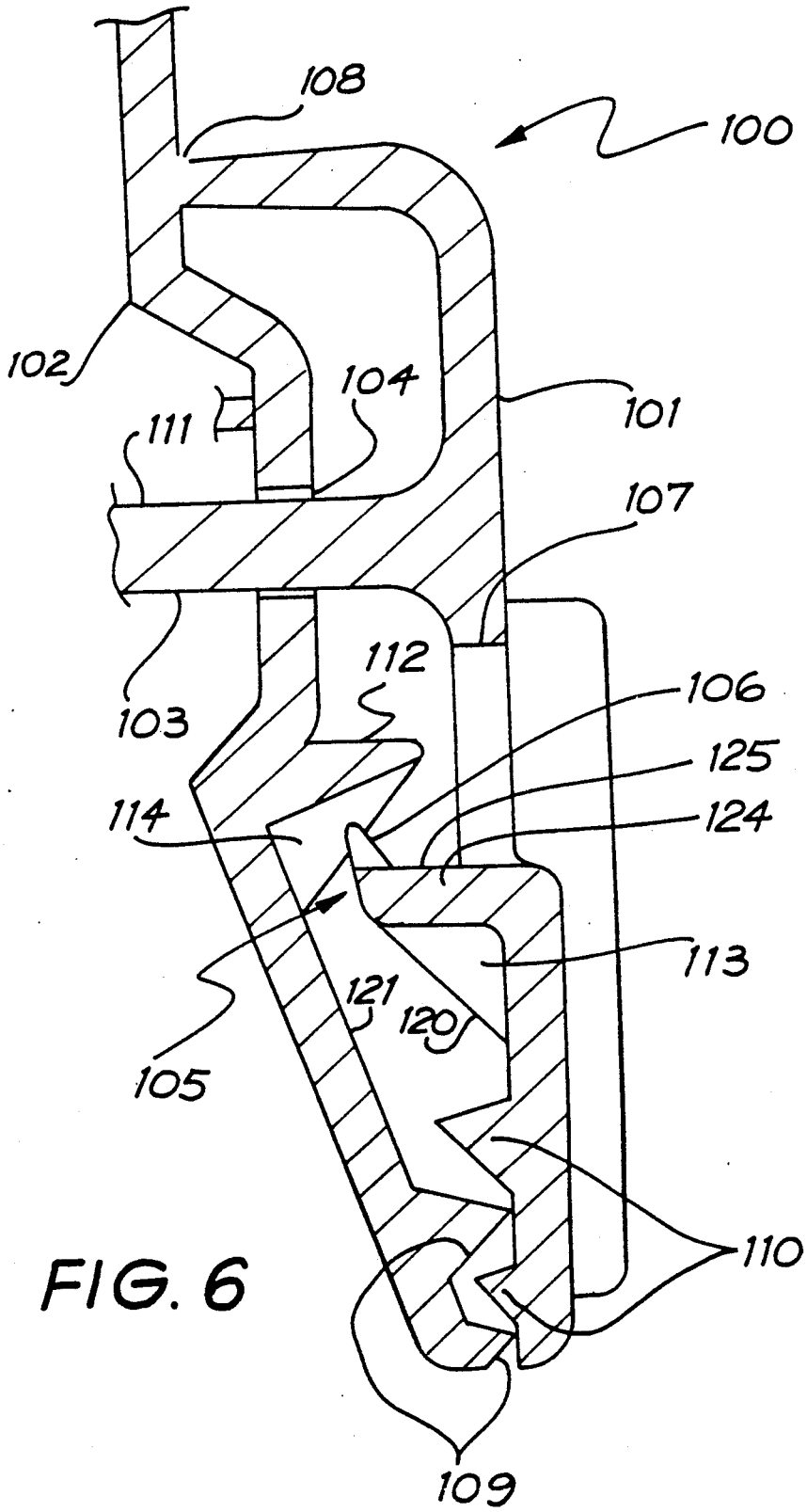
FIG. 6 shows a cross-section through the clip of FIG. 5 when in a closed position.

Referring to FIGS. 5 and 6 there is shown a clip 100 comprised of a rear jaw 101 and a front jaw 102. The jaws 101 and 102 are flexibly joined along a hinge line 108, about which they may pivot relative to each other In FIG. 5 the clip is integral with a clothes hanger.

The two jaws 101 and 102 may be rotated about hinge line 108 to trap a piece of clothing between opposing faces 120 and 121. The piece of cloth is gripped by garment grips 109 and 110 located at or adjacent the free ends 122 and 123 of jaws 101 and 102 respectively. The piece of cloth is also gripped by garment grips 105 and 112, whose operation shall be explained below.

The two jaws 101 and 102 are secured in a gripping position by means of interengagement of saw teeth 111 of ratchet 103 with arm 117 as previously described.

Garment grip 105 comprises an extension 124 extending generally perpendicularly from face 120 towards opposing face 121. The extension 124 is buttressed against downward deflection by buttresses 113. The upper face 125 of extension 124 is generally plannar and at its free end are two upwardly directed protrusions 106. The two protrusions 106 are spaced apart so as to define a space therebetween.

Extending from face 12 of front jaw 120 towards opposing face 120 is a second garment grip 112. The grip 112 is buttressed against deflection by means of buttresses 114. The width of grip 112 is smaller than the space between protrusions 106 and the grip 112 is configured and positioned to overlap the other garment grip 105.

The affect of the interaction of the two garments grips 105 and 112 is that a piece of cloth trapped therebetween is deflected three dimensionally rather than merely two dimensionally along a line, as with interengagements of grips 109 and 110. The piece of cloth trapped by grips 105 and 112 is folded over protrusions 105 and grip 112 and if a downward force is applied to the cloth, tending to draw it out of the clip, the cloth pulls tightly against the protrusion 106 and grip 112, thereby resisting disengagement.

Although described with two protrusions 106 and one extension 112, it is apparent that each clip may be manufactured with two extensions and three protrusions 106, defining two spaces, one for extension.

It will be obvious to those skilled in the art that different materials and amended configurations may be used without departing from the scope or spirit of the present invention and as such it is intended that such variations may be incorporated herein by inference.

I claim:

1. A garment clip comprised of first and second jaws pivotably joined together about a hinge line;

securement means to releasably lock the relative angular position of the two jaws;

first garment gripping means on the first jaw; and second garment gripping means on the second jaw; said securement means being interposed between said hinge line and said first and second garment gripping means;

whereby in use a piece of garment is sandwiched between the two jaws by said garment gripping means, the first and second garment gripping means distorting the garment between themselves into a three dimensionally curved surface.

2. The device of claim 1 wherein the securement means is a ratchet comprised of a ratchet means integral with one jaw and ratchet engaging means integral with the other jaw.

3. The device of claim 2 wherein the ratchet increases the locking force upon application of a force urging the two jaws apart.

4. The device of claim 1 wherein the first garment gripping means comprises a generally planar extension from the first jaw, substantially perpendicular thereto extending towards the second jaw, the free end of the extension having transversly spaced apart protrusions upon an upper face of the extension.

5. The device of claim 4 wherein the protrusions comprise two protrusions at or adjacent each lateral edge of the extension spaced so that the second garment gripping means overlaps the first garment gripping means intermediate the protrusions.

6. The device of claim 1 wherein the first and second garment gripping means are each intermediate the hinge and the free end of the respective jaw.

* * * * *